US006575342B1

(12) United States Patent
Sundara et al.

(10) Patent No.: US 6,575,342 B1
(45) Date of Patent: Jun. 10, 2003

(54) CHILD CARRIER

(75) Inventors: Chloe H. Sundara, Mill Valley, CA (US); John M. Williams, San Francisco, CA (US); Hans Wain, Truckee, CA (US); David Silva, San Francisco, CA (US); Jonathan Gray, Berkeley, CA (US)

(73) Assignee: Sundara Industries, LTD, Mill Valley, CA (US)

( * ) Notice: Subject to any disclaimer, the term of this patent is extended or adjusted under 35 U.S.C. 154(b) by 80 days.

(21) Appl. No.: 09/793,276

(22) Filed: Feb. 26, 2001

Related U.S. Application Data

(60) Provisional application No. 60/210,200, filed on Jun. 8, 2000.

(51) Int. Cl.[7] ..... A61G 1/00

(52) U.S. Cl. ..... 224/161; 224/158; 224/160

(58) Field of Search ..... 297/465, 118, 297/129, 130, 184.11, 184.13, 184.17; D3/213, 214; 224/577, 155, 634, 637, 575, 576, 158, 159, 160, 161

(56) References Cited

U.S. PATENT DOCUMENTS 5,494,329 A * 2/1996 Gonzalez et al. ..... 297/184.13
5,609,279 A * 3/1997 O'Shea ..... 224/160
5,626,271 A * 5/1997 Messey et al. ..... 224/161
D394,546 S * 5/1998 Svendsen et al. ..... D3/214
6,155,579 A * 12/2000 Eyman et al. ..... 280/30
6,158,641 A * 12/2000 Eyman et al. ..... 224/577
6,318,608 B1 * 11/2001 Fowler et al. ..... 224/161

* cited by examiner

*Primary Examiner*—Peter M. Cuomo
*Assistant Examiner*—Stephen Vu
(74) *Attorney, Agent, or Firm*—Blakely, Sokoloff, Taylor & Zafman LLP

(57) ABSTRACT

A child carrier utilized to carry a child on the back of an adult is described. The child carrier includes a rigid frame having front and rear sections. The front section, adjacent to the user's back, comprises a pair of rigid columnar members joined at their top ends by a rigid yoke. In preferred embodiments, the yoke has slots formed therein to serve as a handle and to provide connecting points for the shoulder straps. A child restraint system is described wherein a floating loop is formed by the interconnection of the shoulder straps and the crouch strap. A rigid canopy is described comprising arcuate rigid members that connect to the front and rear sections of the rigid frame, and a flexible hood. A waist belt assembly is also described that permits a waist belt to be adjusted vertically to account for different builds of various users.

49 Claims, 8 Drawing Sheets

CHILD CARRIER

CROSS-REFERENCE TO RELATED APPLICATION

The application claims priority of an earlier provisional application Serial No. 60/210,200 filed on Jun. 8, 2000.

FIELD OF INVENTION

This invention relates generally to devices for transporting children. More particularly, the invention relates to back-mounted child carriers.

BACKGROUND

Child carriers which permit a user to transport a child on one's back supported by the user's shoulder and back are well known. These carriers typically comprise a rigid frame fabricated from aluminum tubing, a cockpit in which a child is secured, typically through the use of one or more belts, and a mounting portion to which shoulder straps are attached by which the carrier is supported on the back of a user. Additionally, many child carriers include waist belts that allow the user to secure the lower portion of the carrier firmly against the user's back.

Current art child carriers often are adjustable to fit the back of different-sized users such as both of a child and parents. Generally, a shoulder strap length adjustment is provided, as is a waist belt size adjustment. Some child carriers also permit adjustment of the height of the waist belt, although current designs are somewhat cumbersome and do not permit the user to adjust the height while wearing a loaded child carrier. Typically, such adjustment mechanisms involve multiple straps, buckles and/or hook and loop connections requiring the user to adjust the height of the waist belt prior to placing the baby in the carrier. This makes handing off of a loaded child carrier potentially time-consuming and frustrating. For example, the first user must remove the carrier; the child must be removed from the carrier; the second user must try on the empty carrier to determine the approximate proper position of the waist belt; the second user must remove the carrier and adjust the waist belt; the second user must then try on the carrier again to see if the proper height has been achieved; the carrier must again be removed and the child placed in the carrier; and finally, the second user can put on the loaded carrier completing the transfer. Given the effort involved in the waist belt adjustment, many users will typically not bother to adjust the waist belt, leading to premature fatigue and potential back discomfort from transporting the child in an improperly adjusted carrier.

Furthermore, even when adjusted properly, many current art child carriers are not designed to efficiently transfer and distribute load to a user in such a manner as to maximize the comfort of the user and maximize the safety of the child. For instance, although the current art child carrier may have a waist belt, it is typically fabricated from foam and fabric that cannot effectively transfer the weight of the loaded carrier to the hips of the user. The materials utilized do not have sufficient rigidity to accomplish this task. Consequently, the majority of the weight of the loaded carrier is borne by the user's shoulders. On current art child carriers, the shoulder straps are typically attached to the child carrier by way of stitching or rivets to the fabric covering a rigid frame and not directly to the rigid frame. Consequently, given the flexible nature of the fabric straps and the fabric frame covering, it is often difficult to adjust the shoulder straps precisely to a position that provides an optimum level of support and comfort.

Typically, child restraint systems used in current art carriers incorporate a 5-point , harness comprising two shoulder straps, crotch strap and a waist belt. The term 5-point harness typically refers to the number of locations that the straps of the harness are attached to the seat or cockpit to which a person is to be restrained. 5-point harnesses typically do a good job of restraining the child; however, because of their design, a determined child could possibly, loosen one or more of the shoulder straps and/or crotch harness, by bracing against one strap, such as the crotch strap, to apply pressure to the another strap, such as one of the shoulder straps, causing either or both straps to lengthen due to movement induced within each strap's adjustment buckle. In this circumstance, if the child is able to loosen the straps, the child could slide out of the carrier through the waist belt and the leg hole. Additionally, putting on and removing a loaded child carrier can be tricky, difficult and potentially dangerous. Depending on how the user removes the carrier, it may shift sideways and could cause the child to slide out of the cockpit save for the belt or harness holding the child in place. Accordingly, it is essential that the child restraint systems be of the best possible design.

Some child carriers provide a handle, generally made of fabric webbing, located at the top and center of the user back-rest portion of the carrier that is to be grabbed after removing one arm from a shoulder strap, and used to pull the carrier around from the back to the user's front while lowering the carrier to the ground. Because these handles are fabricated from a pliant material, they are positionally indeterminate when at rest. For instance, the strap handle may fall to the side of the back rest behind and adjacent to the user's back or the handle may fall on the side of the back rest opposite the user's back, facing the child. In either case, a user may have to search around for the handle to grasp it while lowering the child. If the user fails to grab the handle and releases the other shoulder strap, the child and carrier may fall. Alternatively, the user may find it easier to forgo using the handle altogether, using the top of the shoulder strap as a handle by which to lower the child carrier. Depending on how the shoulder strap is held, the carrier may list to the side or back and upset the child, or the shoulder strap may slip causing the user to drop the child. It is therefore important that any handle utilized to lift a loaded carrier be easy to locate and provide for a sure and confident-inspiring grip.

In general, a child's body is somewhat protected by the aluminum, rigid frame of the carrier. When the carrier is being used, however, especially if the user is hiking in a forest or near trees, branches hanging over the path may impact the child's head causing injury. Some child carriers provide canopies that cover at least a portion of a child's head, however these canopies are primarily designed to shade a child from the sun or protect the child from wind, but these provide no resistance to impact from solid objects.

SUMMARY OF THE INVENTION

An improved child carrier is described. In one embodiment, the front portion of the child carrier's rigid framework comprises two spaced columnar members connected at their top ends by a rigid yoke. In another embodiment, the child carrier has a rigid canopy that includes at least one accurate rigid columnar member with a hood attached to the accurate rigid columnar member. In other embodiments, the child carrier comprises a child restraint system. The child restraint system includes shoulder straps and a crotch support strap joined together to form a continuous loop that floats within the backside of the child cockpit. Other embodiments are contemplated as would be apparent to someone skilled in the art after reading the specification and claims presented herein.

DESCRIPTION OF THE DRAWINGS

The present invention is illustrated by way of example, and not by way of limitation, in the accompanying figures in which like reference numerals refer to similar elements and features.

DETAILED DESCRIPTION

Figure 1:
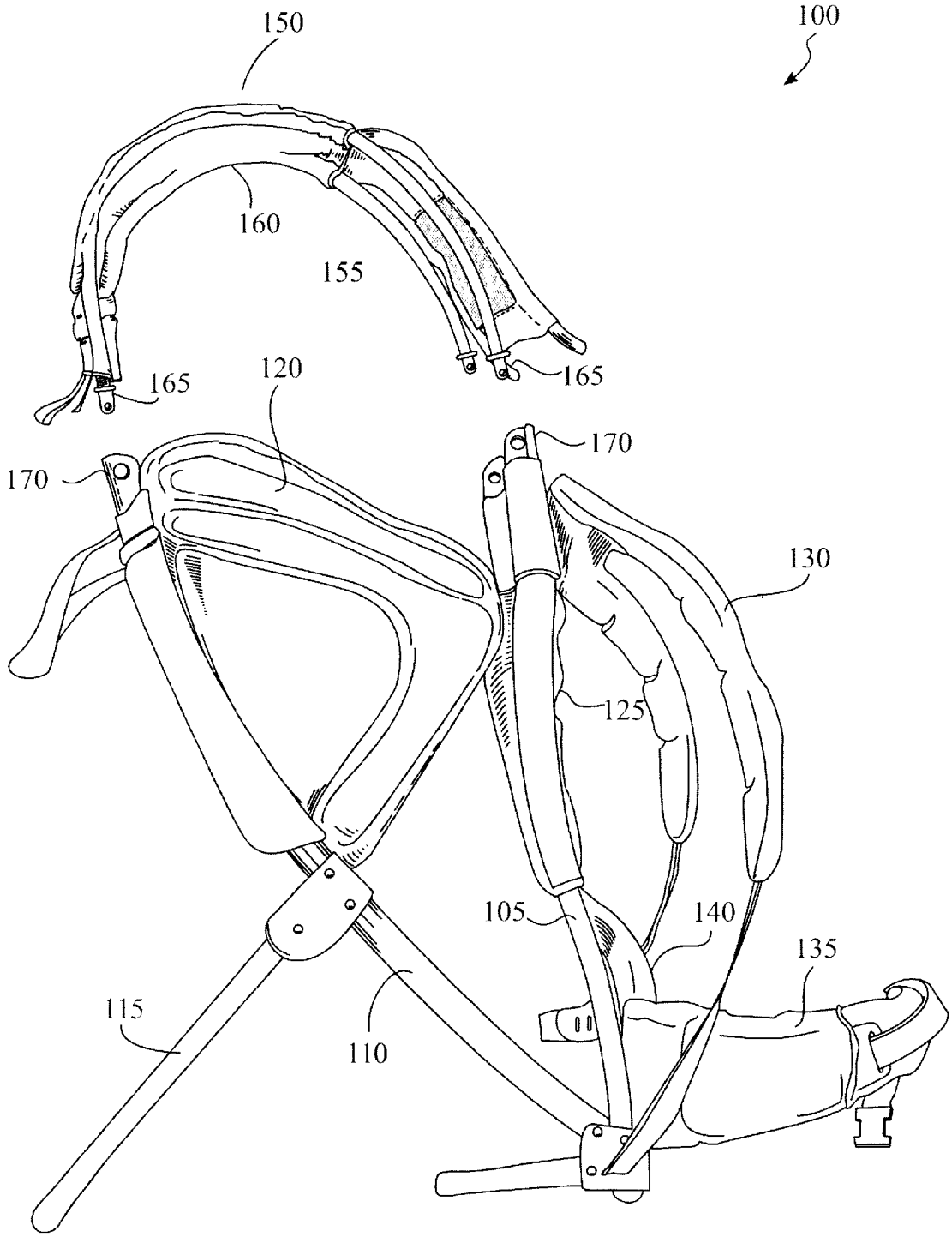
FIG. 1 illustrates a child carrier according to one embodiment of the invention.

A child carrier having a combination of features is described. In one embodiment, a child carrier having an adjustable waist belt assembly is described. The waist belt assembly comprises a rigid bracket slideably mounted to a rigid frame. An adjustment system is provided, allowing the vertical position of the waist belt assembly to be varied to fit a wide variety of users. In a preferred embodiment, the waist belt assembly is adjustable on-the-fly, permitting a parent to easily and conveniently pass the loaded child carrier to his or her significant other. A properly adjusted waist belt assembly helps ensure that a greater amount of the child carrier's weight can be transferred off of the user's shoulders and onto the user's hips. To provide for even greater load transfer, the waist belt assembly in the preferred embodiment also includes rigid winged members that are attached by hinges to the rigid mounting bracket and rest on the user's hip when the waist belt is secured.

In other embodiments, the rigid frame section adjacent to the user's back (the front portion of the rigid frame) incorporates two vertical tubes joined by a rigid yoke that is typically molded out of plastic. This frame assembly replaces the inverted, U-shaped, tubular, rigid frame section common in prior art child carriers. A preferred yoke assembly includes a number of slots or openings fabricated therein. One slot forms a handle that a user may securely and conveniently grab while removing or putting on a loaded carrier. Two other openings provide secure anchor points for the upper ends of the shoulder straps. In a preferred embodiment, another yoke assembly joins the two vertical members that comprise the rear rigid frame portion that is adjacent to the child's back.

Some embodiments include a canopy comprising two rigid accurate supports that are typically removably interfaced with front and rear portions of the rigid frame. A fabric or plastic shade is typically suspended between the supports to shade the child from sun, wind and rain. The rigid supports also provide the capability to deflect tree branches or other objects that might otherwise impact the head of the child while the user is walking or hiking.

In certain embodiments, the child carrier further comprises a child restraint system incorporating a harness wherein the shoulder straps and the crotch strap are joined together behind the child, typically in the backside of the cockpit to form a floating loop. Because a free floating loop is formed by the shoulder straps and the crotch strap, the child is unable to gain leverage off of one strap to apply force to another strap causing either or both straps to loosen. Instead, the loop will typically rotate a few degrees without having the strap adjustment buckles loosen. Furthermore, because the shoulder straps and crotch strap are interconnected in a loop, length adjustments made to the crotch strap also affect the fit of the shoulder straps, permitting the parent to more quickly and easily secure the child in place. In prior art designs both the shoulder straps and the crotch strap would have to be independently adjusted to ensure the child was properly and securely restrained.

FIG. 1 is an illustration of a preferred embodiment of the child carrier 100. The carrier 100 includes a rigid framework. The rigid frame and its components are illustrated more clearly in FIG. 2. A front portion of the rigid framework is comprised of a pair of vertically-orientated tubular members 105 (typically fabricated from aluminum). The tubular members 105 are spaced from each other and are joined at their top ends by a yoke 205. The yoke 205 is typically fabricated from plastic and provides a rigid connection between the two front tubular members. A rear portion of the rigid frame is also comprised of two tubular members 110 joined by a similar yoke 210. In certain embodiments, a rigid support leg 115 protrudes from the rear tubular members to permit the child carrier to be placed in an upright position on the ground. Typically, leg 115 is retractable so that it may be moved adjacent to the rear tubular members 110 and out of the way when the child carrier is being carried on a user's back.

Referring to FIG. 1, a cockpit 120 to contain a child comprised of fabric and foam padding spans the distance between the front and rear tubular members 105 and 110 providing a secure environment in which to place a child. A user back-rest 125 comprised of fabric and padding spans the space between the front tubular members 105. A pair of shoulder straps 130 are provided, as is a waist belt assembly 135. The waist belt assembly 135 is attached to the front tubular members 105 and includes a lower back pad 140. In certain embodiments, a removable canopy 150 is provided to protect the child from wind, sun and the incidental impact of solid objects such as tree branches. The canopy 150 is comprised of two rigid accurate tubes 155, each having connectors 165 attached to their ends, and a fabric or plastic shade 160 that attaches to the accurate tubes 155 and spans the space there-between. The connectors 165 mate with orifices 170 molded into or connected with the front and rear yokes 205 and 210.

The Waist Belt Assembly

FIGS. 2–5 provide various views of the waist belt assembly 135 and components contained therein. The waist belt assembly 135 is slidably attached to the front tubular members 105 by way of a rigid mounting bracket 215. The rigid bracket 215 may be made of any suitable material, such as metal or composite, although in the preferred embodiment, the rigid mounting bracket 215 is made of an injection-molded plastic material. The mounting bracket 215 has formed therein tubular receptacles 435, which are received on the front tubular members 105. This attachment configuration permits the bracket 215 to freely slide between a plurality of positions along the front tubular members 105.

The waist belt assembly 135 also includes a waist belt 310 and waist belt padding 305. The waist belt padding 305 rests adjacent to a user's waist during use to increase the comfort level of the user. The ends of the waist belt 310 terminate in a buckle or clip 315 and 320 that is attached to the waist belt 310 in a manner that permits the length of the waist belt 310 to be adjusted for users of various waist sizes. The waist belt assembly 135 further includes the lower back pad 140 that acts to support and cushion the back of a user. Typically, the padded and fabric portions of the waist belt assembly 135, such as the back pad 140 and the waist belt padding 305, are attached to the mounting bracket 215 via a loop and hook material (e.g., Velcro™) or straps and buckles at attachment locations in the mounting bracket 215 such as the slots 405 illustrated in FIG. 4.

Figure 3:
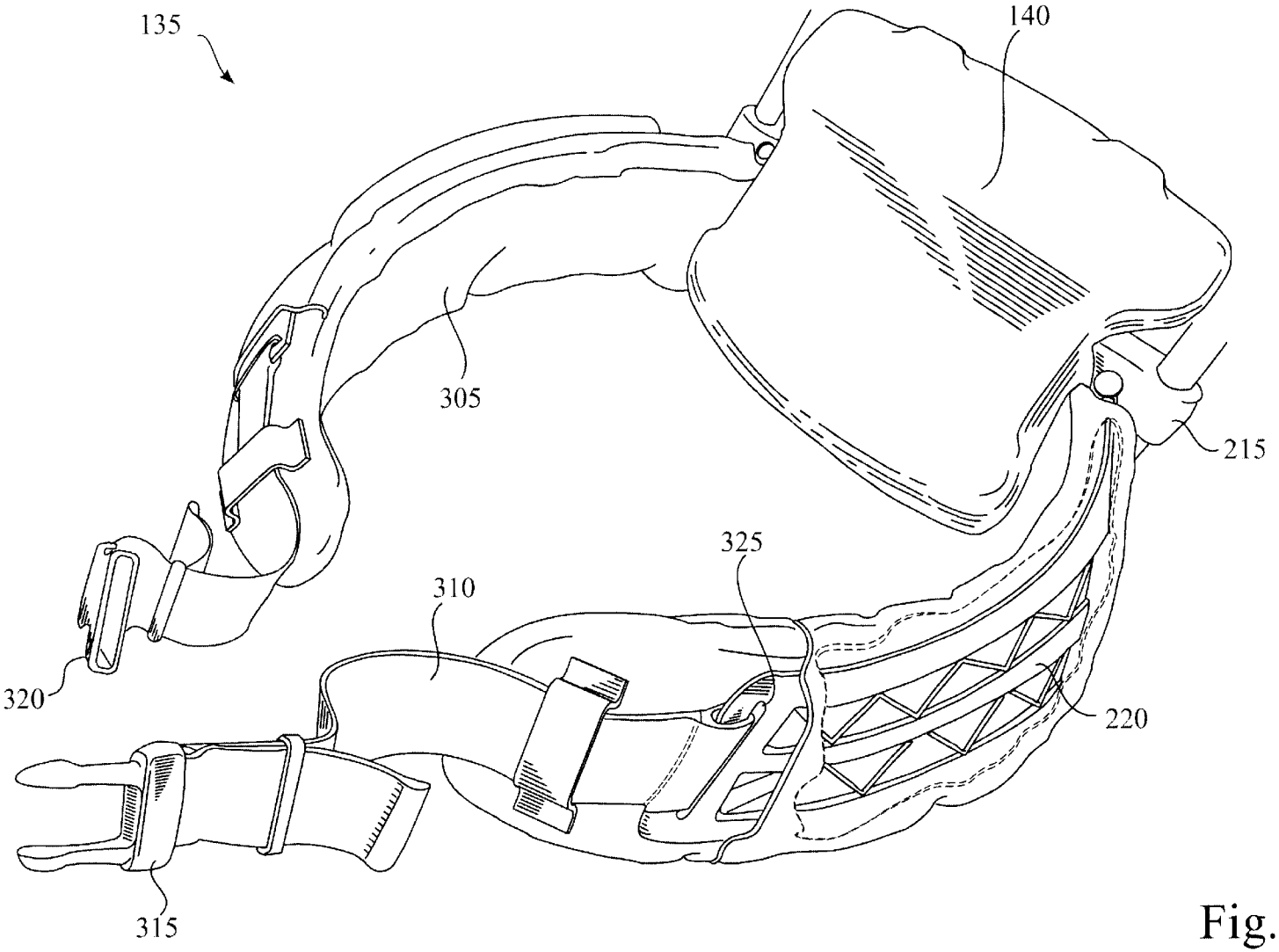
FIG. 3 is an illustration of a child carrier waist belt assembly according to an embodiment of the invention

In a preferred embodiment, the waist belt assembly 135 also comprises a pair of hip load-transfer plates 220 attached to the mounting bracket 215 by way of hinges 225 that permit the plates 220 to rotate about the axis of each hinge 225. The hinges 225 may comprise hinge pin receptacles located on both the mounting bracket 215 and the load-transfer plates 220. The plate 220 may be hidden from view and contained within a pocket formed within the fabric of the waist belt padding 305 as shown in FIG. 3. Each plate 220 includes a slot 325 on the end of the plate opposite the hinge 225, through which one end of the waist belt 310 may be attached, securing the waist belt 310 to the waist belt assembly 135, and operatively integrating the plates into the waist belt assembly 135.

The plates 220 are fabricated from a generally rigid material such as solid plastic or metal and are configured so that they resist deflection from loads applied in a generally vertical direction, such as the weight of a loaded child carrier. Additionally, the plates 220 are flexible and/or resilient to generally horizontal loads such as those that would be applied when buckling the waist belt 310 to a user. Accordingly, the plates 220 conform to the curve of the user's waist when the waist belt 310 is buckled, thus maximizing the contact between the plate 220 and the user's hip through the waist belt padding 305. In the preferred embodiment, the plates 220 are orientated on the mounting bracket 215 such that they cant inward off of vertical anywhere from 0 to 45 degrees with approximately 15–25 degrees being optimal. The cant permits a greater area of the plates 220 to rest against the user's hip through the waist belt padding 305, more effectively and evenly transferring the load to the user's hips.

Figure 4:
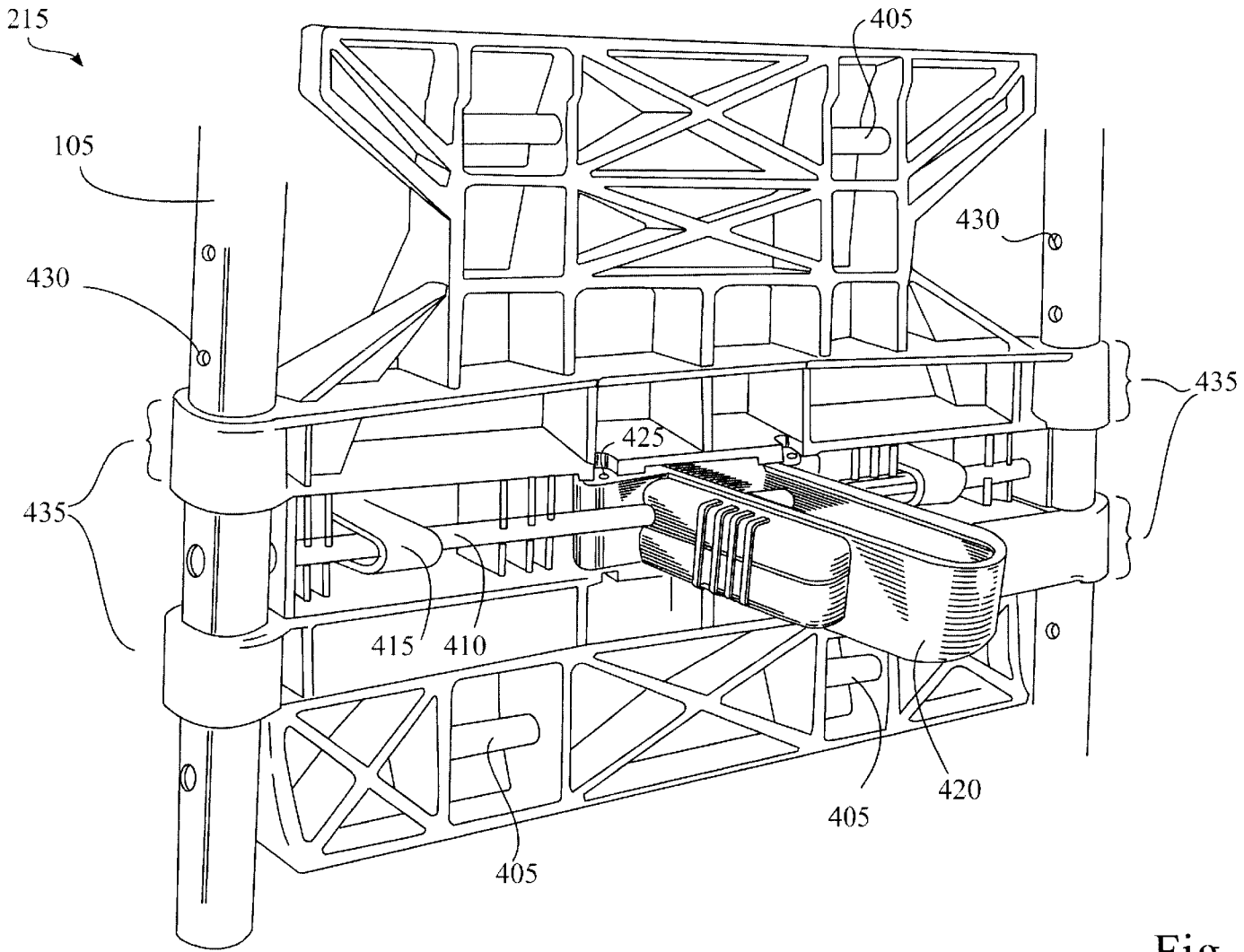
FIG. 4 is an illustration of the rigid back mounting bracket including the waist belt adjustment mechanism according to one embodiment.
Figure 5:
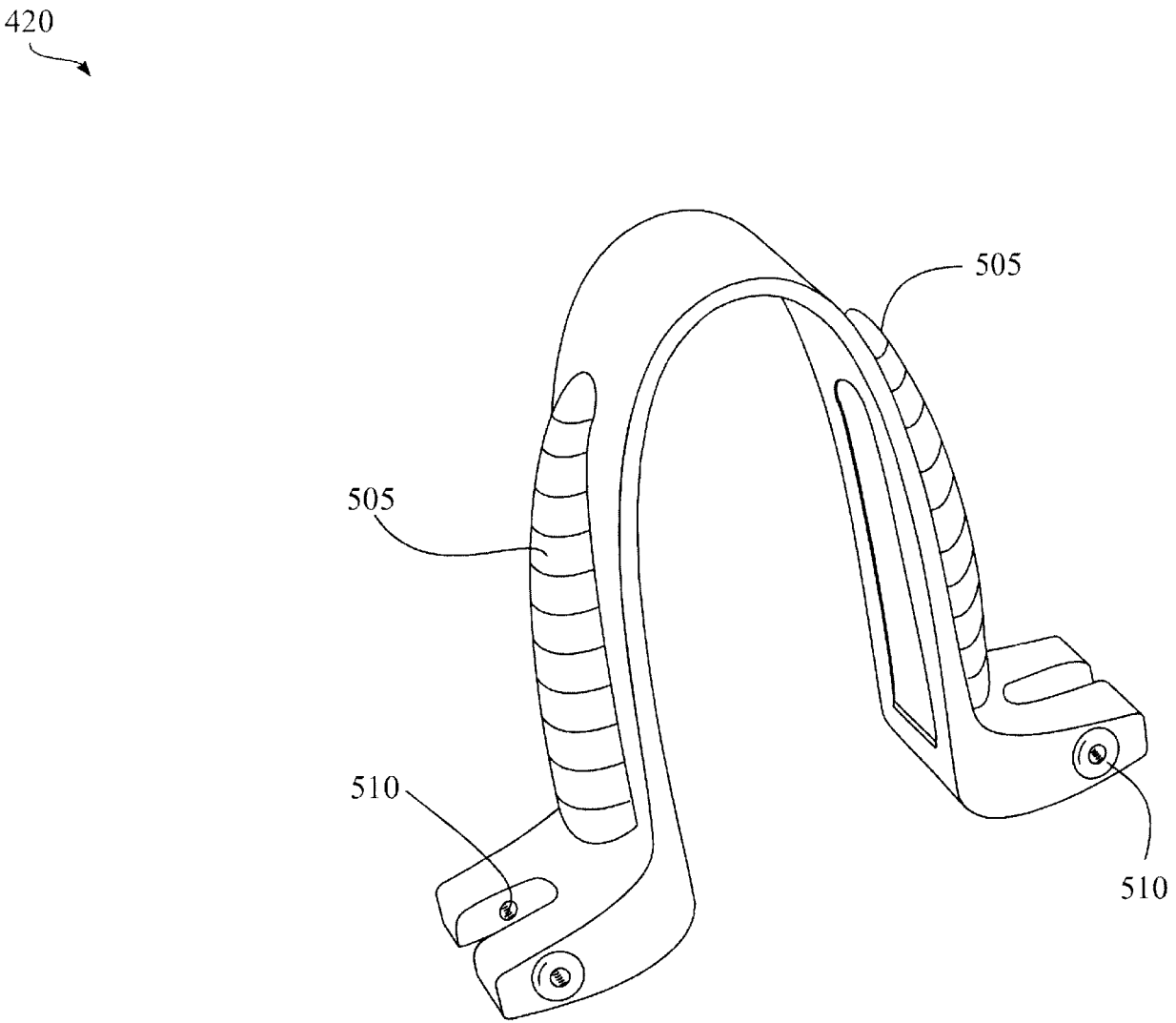
FIG. 5 is an illustration of an adjustment actuator according to one embodiment of the invention.

A locking mechanism is provided to secure the mounting bracket 215 at selected positions along the front tubular members 105. The preferred embodiment locking mechanism comprises an actuator 420 attached to two horizontally-opposed shafts 410, the shafts 410 being contained by guides 415 attached or integrally molded into the mounting bracket 215. The locking mechanism is illustrated in FIG. 4. The actuator 420 is illustrated in FIG. 5.

The selected positions along the front tubular members 105 are defined by openings or holes 430 spaced in the front tubular members 105. In a locked position, each shaft 410 is engaged in one of the holes 430, preventing up or down movement of the mounting bracket 215. The shafts 410 are normally biased in the engaged position, and are moveable within the guides 415 to a disengaged position by depressing the handle surfaces 505 on the U-shaped actuator 420 to overcome the spring force applied by the actuator and pull the shafts 410 out of the holes 430. Each shaft 410 is attached to the actuator 420 by way of a small cotter pin 425 that is engaged in openings 510 in the ends of the actuator 420 and in the shafts 410.

After disengaging the shafts 410 while holding the actuator 420 in the compressed position, the user may freely slide the waist belt assembly 135 along the front tubular members 105 into a desired position using the actuator 420 as a handle. Once the desired position is located, the user may release the actuator 420 causing the actuator 420 to apply a biasing force to the shafts 410 and encourage the shafts 410 into the nearest holes 430 on the front tubular members 105 to relock the waist belt assembly 135 in place. The design of the locking mechanism and the dual functionality of the actuator 420 permits the waist belt assembly 135 to be easily adjusted with a single hand even when the pack is suspended on the back of the user by the shoulder straps 130.

In alternative embodiments, other waist belt assemblies are contemplated that would facilitate adjustment of the waist belt relative to the rigid frame of the child carrier. Additionally, a variety of locking mechanisms and hip load transfer members are also contemplated. Several alternative embodiments of the waist belt assembly are described in United States Patent and Trademark Office application Ser. No. 09/712,524, entitled "Back-Mounted Load-Carrying Apparatus", hereby incorporated by reference.

The Yoke

Figure 6:
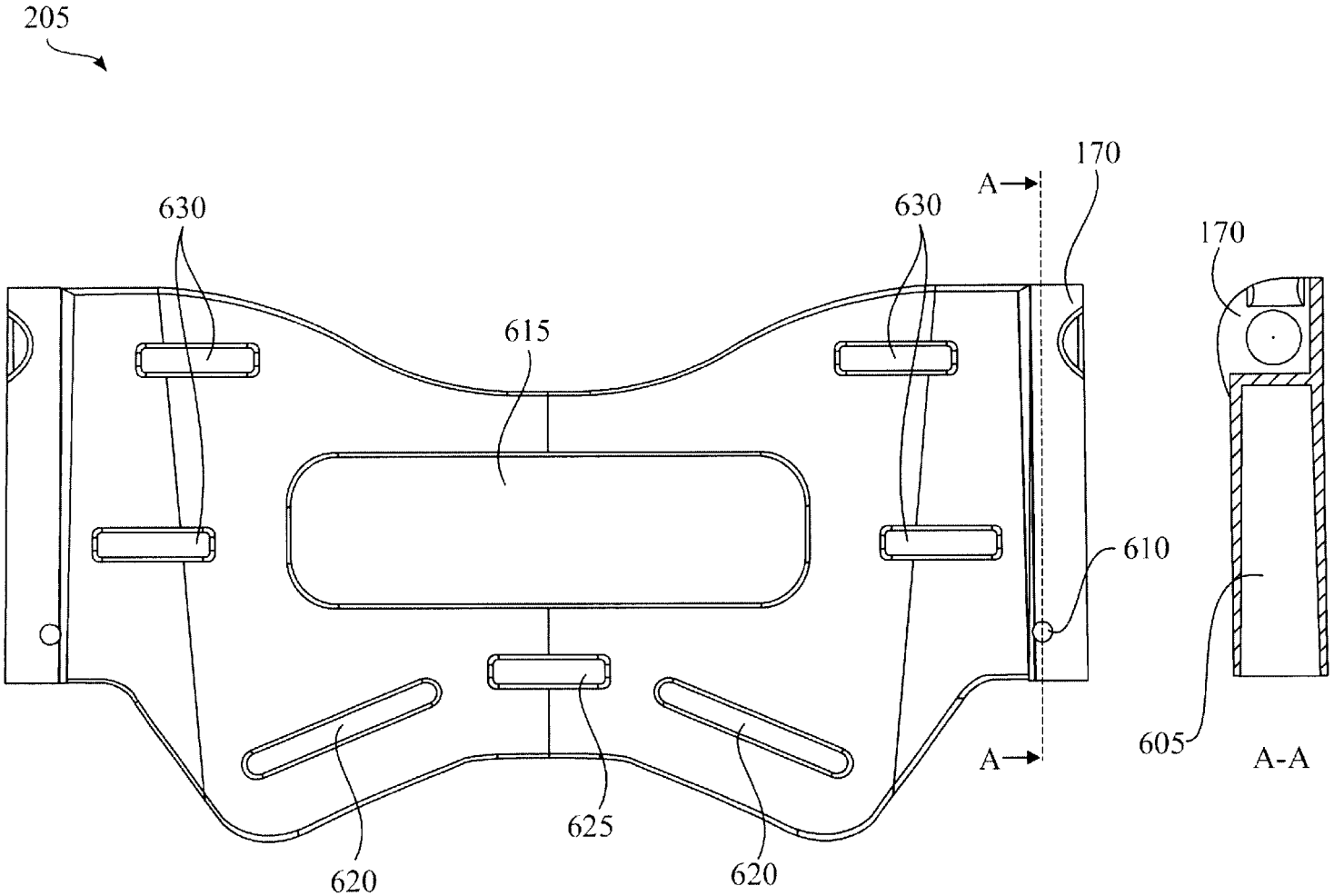
FIG. 6 is an illustration of the yoke assembly according to one embodiment of the present invention.

FIG. 6 provides a front and side illustration of the yoke 205. As discussed supra, the yoke joins the upper ends of the tubular members 105 together, spanning the space between the tubular members 105 as shown in FIG. 1. Typically, the yoke 205 comprises a rigid, molded plastic, although the yoke 205 may be fabricated from a variety of materials including metals and composites. In the preferred embodiment, the ends of the front tubular members 105 are received into receptacles 605 and pinned in place with rivets through pinholes 610. The receptacles may be integrally molded into the yoke or they may separately fabricated and coupled with the yoke.

Besides lending rigidity to the framework, the yoke 205 provides secure anchor points 620 for the shoulder straps 130 and a handle opening 615 from which a user may grab the carrier while either putting it on or removing it. Advantageously, the shoulder straps are firmly secured directly to the rigid framework of the carrier instead of the flexible and resilient fabric covering that forms the user backrest, permitting both accurate and sure adjustment of the straps. Furthermore, the handle opening 615 provides a rigid and confidence-inspiring location from which to lift the child carrier, especially when the carrier is loaded, as opposed to the fabric webbing handles common on prior art child carriers. Several additional slots 625 and 630 are provided at which additional webbing straps may be attached. For instance, in a preferred embodiment, a webbing strap attached with a child crotch support of the cockpit 120 is coupled with and terminated at slot 625.

Embodiments of the child carrier also comprise a rear yoke 210, substantially similar to the front yoke 205. In contrast to the front yoke 205, the rear yoke 210 joins together the rear tubular members 110 of the rigid framework. Additionally, the slots on the rear yoke 210 may be utilized to couple webbing straps to the rigid framework. Although the rear yoke 210 may comprise a handle opening, it may be covered by fabric and padding that comprises the rear of the child cockpit 120 not permitting its use.

Rigid Canopy

Figure 2:
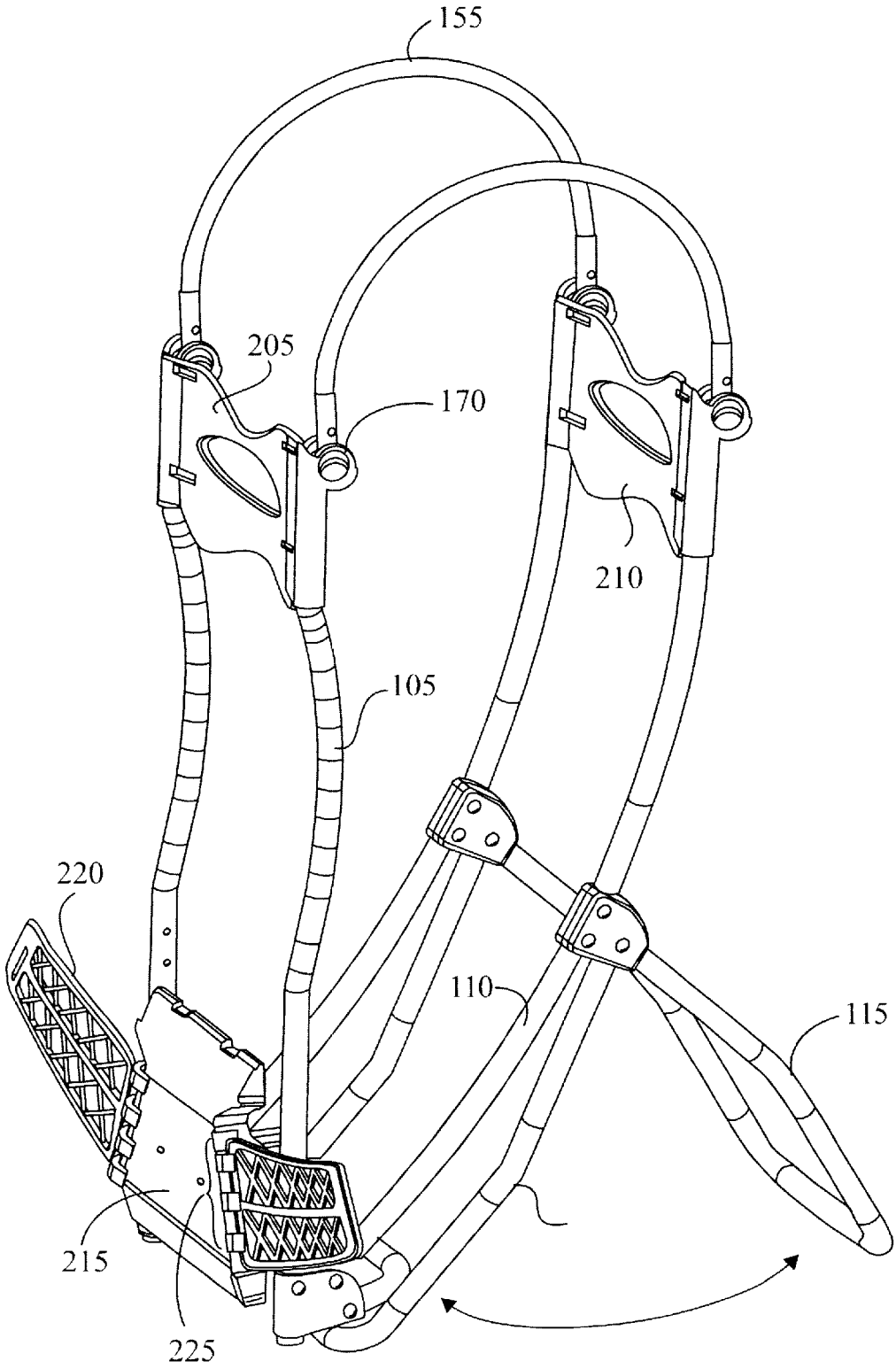
FIG. 2 is an illustration of the child carrier with all fabric and padding portions removed therefrom according to one embodiment of the invention.

A rigid canopy 150 is illustrated in FIG. 1. In a preferred embodiment, the canopy is comprised of two rigid accurate tubes 155 that are attached to the front and rear yokes 205 and 210 and a hood 160 as illustrated in FIG. 2.

The rigid accurate tubes 155 are typically fabricated from aluminum alloy tubing, although the tubes may be fabricated from any number of materials including plastic, composite and other metal alloys. In alternative embodiments, the accurate members may not be tubular; rather, they could comprise any suitable cross-sectional shape.

The hood 160 is typically fabricated from a fabric material and has formed therein along the edges tubular receptacles through which the rigid accurate tubes 155 are received. The hood 160 shades the child from sun and protects the child from the wind. In some embodiments, the hood 160 may comprise a window made of fabric netting or a translucent plastic.

In one embodiment, connectors 165 are attached to the ends of the rigid accurate tubes 155 to facilitate joining with the front and rear yokes 205 and 210. The connectors 165 may be fabricated from a number of materials including metals, plastics, or composites. The connectors 165 may comprise a male member that fits into the ends of the rigid tubes 155 and is held in place by rivets, adhesive and/or friction. Compatible, related connectors, such as the orifices 170 illustrated in FIG. 2, receive the connectors 165. The related connectors may be integrally molded into the yokes 205 and 210 or they may be mechanically or adhesively attached to the yokes 205 and 210. In a preferred embodiment, the design of the connectors are such that the rigid canopy 150, when either the front or rear connectors are uncoupled, may be rotated about an axis formed by the other of the front or rear connectors. For example, a user may uncouple both the front connectors, and rotate the rigid canopy 150 back behind the child cockpit 120 about the still-coupled rear connectors to gain access to the child.

The Child Cockpit and the Child Retention System

Figure 7:
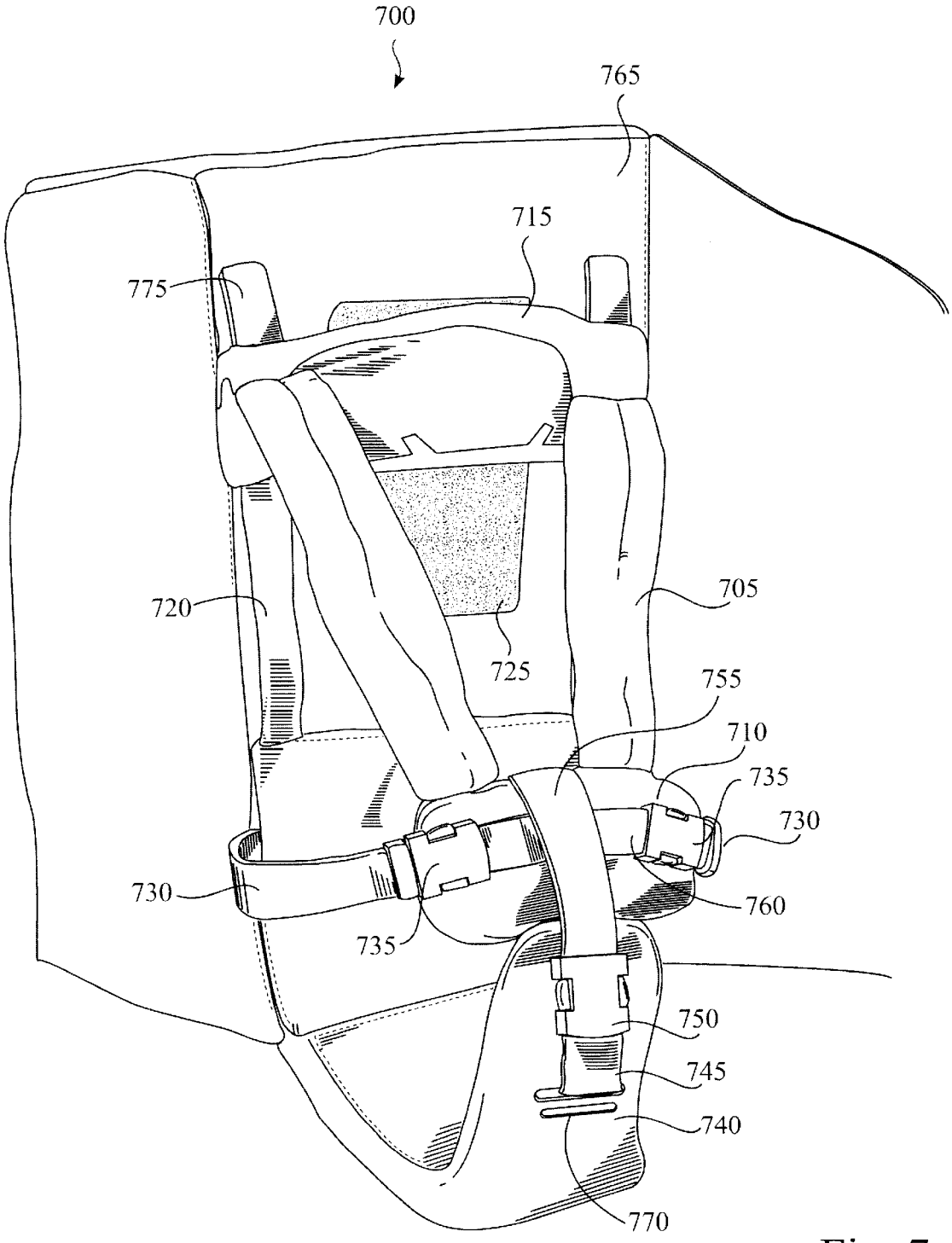
FIG. 7 is an illustration of the child retention harness according to one embodiment of the invention.
Figure 8:
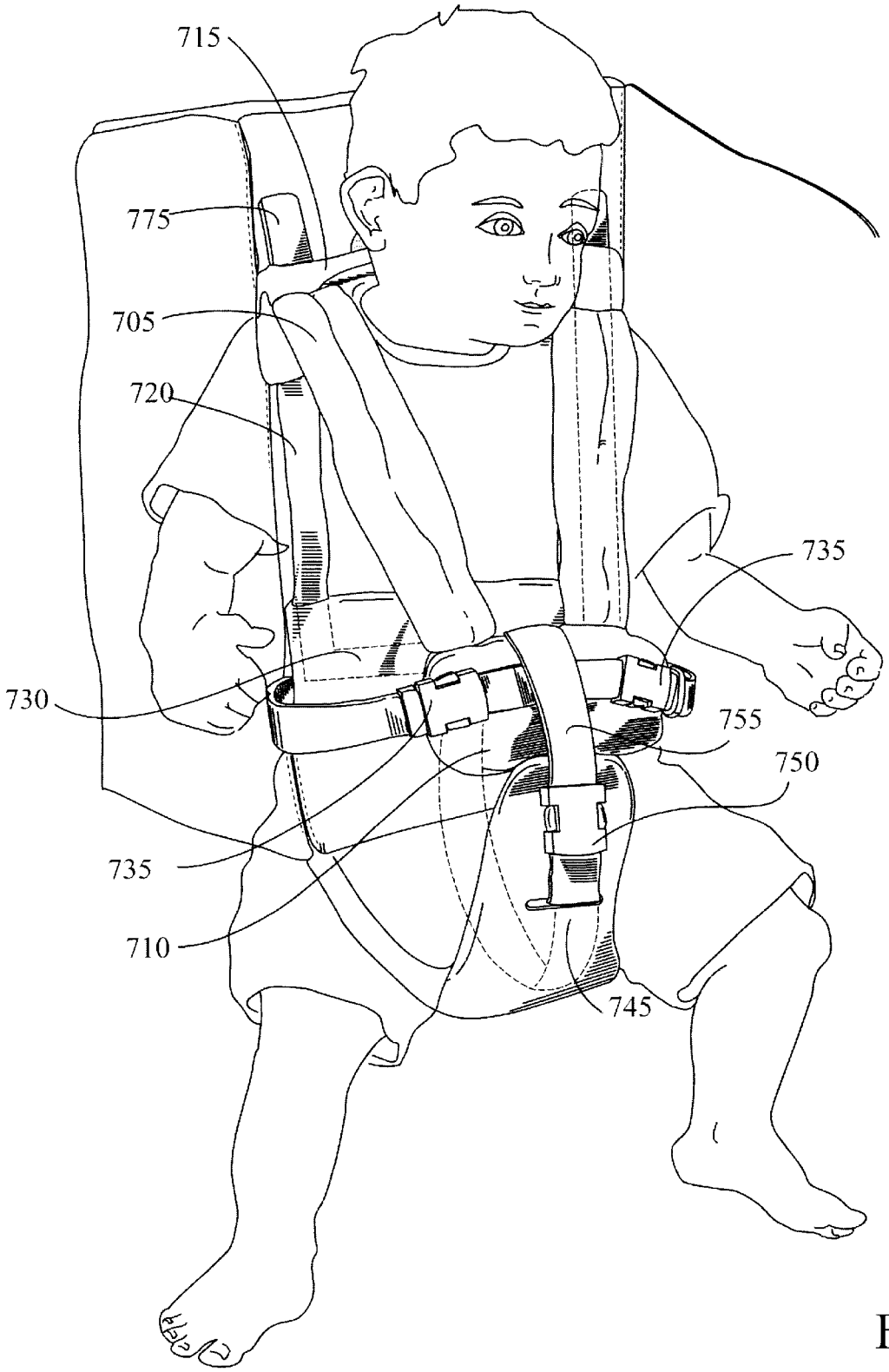
FIG. 8 is an illustration of the child retention harness with a child restrained therein according to one embodiment of the invention.

As described supra, a child cockpit 120 spans the distance between the front and rear portions of the rigid framework. Side panels as shown in FIG. 1 provide side protection to the child and are usually comprised of fabric-covered padding. In between the side panels, child retention system 700 is attached to a child back support 765 of the cockpit 120. The child back support 765 is typically fabricated of fabric and padding and spans the space between the rear tubular members 110. The child retention system 700 is illustrated in FIG. 7, and illustrated in FIG. 8 with a child secured therein.

The child retention system 700 includes a neck pad portion 715 which contains padding to cushion the child's neck. The neck pad portion 715 is slidably attached to two webbing rails 775. The webbing rails 775 are spaced from each other, attached to the back support 765, and extend in a generally vertical direction. Furthermore, the neck pad portion 715 is fixedly attached to the ends of two additional vertically-extending straps 720. The two vertically-extending straps 720 are spaced from each other and are substantially adjacent to the webbing rails 775 such that the webbing rails 775 are hidden from view where the vertically-extending straps 720 and the webbing rails 775 overlap, as illustrated in FIG. 7. The backside of the neck pad portion 715 has a section of hook and loop material attached thereto. The adjacent portion of the back support 765 has a hook and loop material section 725 attached thereto corresponding to and directly opposite the hook and loop material attached to the neck pad portion 715. Operationally, the neck pad portion 715 may be adjusted vertically to accommodate children of varying sizes by sliding the neck pad portion 715 along the webbing rails 775 and securing the neck pad portion 715 in place by pressing the adjacent and corresponding hook and loop sections together.

The tops of two shoulder straps 705 are securely coupled to the neck pad 715, the top of each shoulder strap 705 being approximately inline with either the right or left webbing strap 720. The lower ends of the shoulder straps 705 are attached to a stomach pad portion 710. The shoulder straps 705 typically comprise fabric and padding material.

Several buckles 735 and 750 are connected with the stomach pad portion 710 via webbing straps 755 and 760. Snap-type buckles having male and female ends are illustrated, however any suitable type of buckle is contemplated. A left waist belt strap 730 connects to left buckle 735, and a right waist belt strap 730 connects to the right buckle 735. The other ends of the right and left waist belt straps 730 are affixed to the child back support 765. A third buckle 750 is adjustably connected to a crotch support strap 745. The crotch support strap 745 is more clearly illustrated as broken lines in FIG. 8 where it passes under the crotch area of a child and is attached to a generally horizontally-extending strap 780 that is enclosed within the fabric face of the child back support 765. The crotch strap 745 is substantially enclosed in a crotch pad 740. The crotch pad 740 provides an intervening padded interface between the child's bottom and the crotch support strap 745, thereby maximizing the child's comfort. A front child retention system support strap is further attached to the crotch support pad 740 at or about location 770. The front child retention system support strap, not shown in the Figures, also interfaces both with the back of the user's back pad 125 and with the front yoke through an intermediate webbing strap that terminates at slot 625.

The opposite ends of the horizontally-extending strap 780 are attached to ends of the vertical webbing straps 720 that are opposite the neck pad 715. Although the horizontally-extending strap 780 is contained within the child back support 765, it is not attached thereto, essentially floating therein. As a result, a closed loop restraining harness with a portion floating within the child back support 765 and the crouch pad 740 is formed by the shoulder straps 705, the neck pad 715, the stomach pad 710, the vertical straps 720, the horizontally-extending strap 780, and the crouch strap 745.

ALTERNATIVE EMBODIMENTS

The embodiments described heretofore are merely illustrative and are not intended to limit the scope of the appended claims. Rather, all embodiments of the invention are contemplated as would be obvious to one of reasonable skill in the art who has had the benefit of this disclosure.

For example, in certain embodiments, the front and rear portions of rigid framework may be comprised of longitudinal members that are not tubular. In other embodiments, the framework may have an altogether different configuration. In yet other embodiments, the front and rear portions of framework may not utilize yokes, each being comprised of a single tube bent into an inverted U-shape as is common on some prior art carriers.

It is contemplated that not all embodiments shall incorporate all of the features discussed herein. Some embodiments may include the rigid canopy when available. A number of different type connectors are contemplated to attach the rigid canopy to the rigid framework.

Embodiments may incorporate an adjustable moveable belt assembly with or without the hip plates. Other types of hip load transfer members may be utilized such as curved cylindrical members. The child restraining system may differ from the system described, wherein the points of attachment of the straps vary. For instance, in some embodiments the left and right halves of the waist belt might buckle directly together rather than connect to stomach pad 710. In other embodiments, there may not be a stomach pad 710. Instead, the pad 710 may be replaced by any number of elements that can conjoin the shoulder straps, the waist straps and the crouch strap. For instance, a molded junction having buckle ends and/or slots to receive each of the straps is contemplated.

We claim:

1. A child carrier comprising:

a rigid framework, the rigid framework including a front portion and a rear portion, the front portion comprising two generally vertical front columnar members, the two front columnar members spaced from each other, each having a top end, and a rigid yoke, the rigid yoke having two chambers formed therein, each said yoke chamber being connected with a respective one of the two front columnar members substantially at the top end of the respective front columnar member;

a child cockpit suspended between the front and rear portions, and at least one shoulder strap connected with the front portion.

2. The child carrier of claim 1, wherein the two columnar members are tubular.

3. The child carrier of claim 1, wherein the rear portion comprises two generally vertical rear columnar members, the two rear columnar members spaced from each other, each having a top end, and a rigid yoke, the rigid yoke connected with the two rear columnar members substantially at the top end of each said rear columnar member.

4. The child carrier of claim 1, wherein the yoke has formed therein a first slot, the first slot having a width and height of sufficient dimensions so that at least four adult human fingers can be inserted therein.

5. The child carrier of claim 1, wherein the rigid yoke has formed therein at least one shoulder strap slot, and a top end of the at least one shoulder strap passes through the at least one shoulder strap slot.

6. The child carrier of claim 1, wherein the rigid yoke has formed therein a crotch support strap slot, and a strap connected with a crotch support of the child cockpit passes through the crotch support strap slot.

7. The child carrier of claim 1, wherein:

the rigid yoke has formed therein a first slot, the first slot having a width and height of sufficient dimensions so that at least four adult human fingers can be inserted therein, and the yoke has further formed therein at least one shoulder strap slot, and a top end of the at least one shoulder strap passes through the at least one shoulder strap slot.

8. The child carrier of claim 1, further comprising:

a waist belt assembly, the waist belt assembly being vertically adjustable along at least one of the two front columnar members.

9. The child carrier of claim 1, further comprising:

a waist belt assembly, the waist belt assembly including a rigid mounting bracket connected with the two front columnar members, and a pair of hip-load transfer members that are substantially rigid in a generally vertical direction, the pair of hip-load transfer plates being movably attached to the rigid mounting bracket.

10. The child carrier of claim 1, wherein the rear portion comprises two generally vertical rear columnar members, the two rear columnar members spaced from each other, each having a top end, and a rigid yoke, the rigid yoke connected with the two rear columnar members substantially at the top end of each said rear columnar member.

11. The child carrier of claim 1, wherein the rigid yoke has formed therein at least one shoulder strap slot, and a top end of the at least one shoulder strap passes through the at least one shoulder strap slot.

12. The child carrier of claim 1, wherein the rigid yoke has formed therein a crotch support strap slot, and a strap connected with a crotch support of the child cockpit passes through the crotch support strap slot.

13. The child carrier of claim 1, wherein two chambers are formed in the yoke, each said chamber having received therein the top end of each of the two front columnar members.

14. The child carrier of claim 1, further comprising:

a waist belt assembly, the waist belt assembly being vertically adjustable along at least one of the two front columnar members.

15. A child carrier comprising:

a rigid framework, the rigid framework including a front portion and a rear portion, the front portion comprising two generally vertical front columnar members, the two front columnar members spaced from each other, each having a top end, and a rigid yoke, the rigid yoke having two chambers formed therein, each said yoke chamber being connected with a respective one of the two front columnar members substantially at the top end of the respective front columnar member;

a child cockpit suspended between the front and rear portions, and at least one shoulder strap connected with the front portion; and a waist belt assembly, the waist belt assembly including:

a single rigid mounting bracket connected to at least one of the two front columnar members to permit the rigid mounting bracket to freely slide at least vertically along at least a portion of at least one of the two front columnar members, and a waist belt coupled with the rigid mounting bracket.

16. The child carrier of claim 15, wherein the waist belt assembly further comprises a locking mechanism to lock the waist belt assembly to at least one of the two front columnar members at one of a plurality of positions.

17. The child carrier of claim 15, wherein the waist belt further includes two hip-load transfer members, the two hip-load transfer members being rotatably attached to the rigid mounting bracket.

18. The child carrier of claim 17, wherein the two hip-load transfer plates are rotatably attached to the rigid mounting bracket by hinges.

19. A child carrier comprising:

a rigid framework, the rigid framework including a front portion and a rear portion, the front portion comprising two generally vertical front columnar members, the two front columnar members spaced from each other, each having a top end, and a rigid yoke, the rigid yoke having two chambers formed therein, each said yoke chamber being connected with a respective one of the two front columnar members substantially at the top end of the respective front columnar member;

a child cockpit suspended between the front and rear portions; and at least one shoulder strap connected with the front portion;

a waist belt assembly, the waist belt assembly including:

a single rigid mounting bracket connected to at least one of the two front columnar members to permit the rigid mounting bracket to freely slide at least vertically along at least a portion of at least one of the two front columnar members, and;

a rigid canopy, the rigid canopy including:

(i) at least one arcuate rigid columnar member having front and rear ends;

(ii) a first front connector coupled with the front end;

(iii) a first rear connector coupled with the rear end, and (iv) a hood coupled with the at least one arcuate rigid columnar member;

a second front connector coupled with the front portion, the second front connector being removably connectable with the first front connector; and a second rear connector coupled with the rear portion, the second rear connector being removably connectable with the first rear connector.

20. The child carrier of claim 19, wherein the first rear connector is rotatably connectable with the second rear connector, permitting the at least one arcuate rigid columnar member to be rotated relative to the rear portion when the first and second rear connectors are engaged and the first and second front connectors are disengaged.

21. The child carrier of claim 19, wherein the second front connector is integrally molded as part of the rigid yoke.

22. A child carrier comprising:

a rigid framework, the rigid framework including a front portion and a rear portion, the front portion comprising two generally vertical front columnar members, the two front columnar members spaced from each other, each having a top end, and a rigid yoke, the rigid yoke having two chambers formed therein, each said yoke chamber being connected with a respective one of the two front columnar members substantially at the top end of the respective front columnar member;

a child back support, the child back support adjacent and connected with the rear portion; and a child restraint system, the child restraint system comprising:

right and left child shoulder straps, the right and left child shoulder straps each having a top and bottom end, the child shoulder strap top ends being spaced from each other and at least one child shoulder strap of the right and left child shoulder straps being attached to a substantially vertically orientated strap, at least a portion of the vertically orientated strap slidably connected with the child back support;

a crotch support, the crotch support having a back end and an upper end, the crotch support extending from a lower portion of the child back support and terminating at an upper end, the back end being in operative connection with the substantially vertically extending strap; and an intermediate restraint member, the intermediate restraint member having attached therewith (i) each of the left and right child shoulder straps bottom ends, and (ii) the upper end of the crotch support, whereby the combination of the interconnected at least one child shoulder strap, the substantially vertically extending strap, the crotch strap and the intermediate restraint member form a loop.

23. A child carrier comprising:

a rigid framework, the rigid framework including a front portion and a rear portion, the front portion having attached thereto at least one first front connector, and the rear portion having attached thereto at least one first rear connector;

at least one shoulder strap connected with the front portion;

a child cockpit suspended between the front and rear portions; and a rigid canopy, the rigid canopy including:

(i) at least one arcuate rigid columnar member having front and rear ends;

(ii) at least one second front connector coupled with the front end, the at least one second front connector being removeably connectable with the at least one first front connector;

(iii) at least one second rear connector coupled with the rear end, the at least one second rear connector being removably connectable with the at least one first rear connector; and (iv) a hood coupled with the at least one arcuate rigid columnar member, the hood being suspended over a significant portion of the child cockpit.

24. The child carrier of claim 23, wherein the at least one arcuate rigid columnar member is tubular.

25. The child carrier of claim 23, wherein the at least one first and second rear connectors when connected permit the at least one second rear connector to rotate about the at least one first rear connector.

26. The child carrier of claim 23, wherein the front portion further comprises:

(i) two generally vertical front columnar members, the two front columnar members spaced from each other, each having a top end; and (ii) a rigid yoke, the rigid yoke connected with the two front columnar members substantially at the top end of each said front columnar member.

27. The child carrier of claim 26, wherein the at least one first front connector is fixedly attached to the rigid yoke.

28. The child carrier of claim 26, wherein the at least one first front connector is integrally fabricated as part of the rigid yoke.

29. A child carrier comprising:

a rigid framework, the rigid framework including a front portion and a rear portion, the front portion having attached thereto a left first front connector and a right first front connector, and the rear portion having attached thereto a left first rear connector and a right first rear connector;

at least one shoulder strap connected with the front portion;

a child cockpit suspended between the front and rear portions; and a rigid canopy, the rigid canopy including:

(i) left and right arcuate rigid columnar members spaced from each other and each having front and rear ends;

(ii) left and right second front connectors coupled with the front end of the left and right arcuate rigid columnar members, the left and right second front connectors being removably connectable with the left and right first front connectors;

(iii) left and right second rear connectors coupled with the rear end of the left and right arcuate rigid columnar members, the left and right second rear connectors being removably connectable with the rear and right first rear connectors; and (iv) a hood coupled with the left and right arcuate rigid columnar members.

30. The child carrier of claim 29, wherein the left first rear connector and the left second rear connector when connected permit the left second rear connector to rotate about the left first rear connector.

31. The child carrier of claim 29, wherein the hood has formed thereon left and right sleeves in which at least a portion of the left and right arcuate right columnar members are contained.

32. A child carrier comprising:

a rigid framework, the rigid framework including a front portion and a rear portion;

at least one shoulder strap connected with the front portion; and a child cockpit suspended between the front and rear portions, the child cockpit including a child back support portion, and a child restraint system, the child restraint system comprising:

(i) a pair of child shoulder straps, each of the pair of child shoulder straps having a top and bottom end;

(ii) a crotch support strap, the crotch support strap extending from a back end and terminating at an upper end, the upper end being connectively coupled with the bottom end of each of the pair of child shoulder straps; and (iii) one or more strap members located at least partially contained within said child back support portion, the one or more strap members connected with the back end of the crotch support strap and the top end of each of the pair of child shoulder straps by way of a neck pad.

33. The child carrier of claim 32, wherein the one or more strap members are connected with the top end of each of the pair of child shoulder straps by way of a neck pad portion.

34. The child carrier of claim 33, wherein the neck pad is slidably attached with the child back pad portion permitting the vertical position of the child neck pad to be varied relative to the child back support portion.

35. The child carrier of claim 32, wherein the child neck pad comprises a back side surface adjacent the child back support portion, the back side surface and an adjacent portion of the child back support portion having secured thereto corresponding sections of hook and loop material permitting the child neck pad to be attached to the child back support portion.

36. The child carrier of claim 32, wherein the child neck pad is slidably attached with the child back support portion through a pair of substantially parallel, substantially vertical straps, each said vertical strap of the pair of vertical straps being attached to the child back support portion at a top and bottom end of each said vertical strap.

37. The child carrier of claim 32, wherein the upper end of the crotch support strap and the bottom end of each of the pair of child shoulder straps are connected with each other by way of an intermediate restraint member.

38. The child carrier of claim 37, further comprising left and right waist belt straps, each said waist belt strap having a first end attached with the child back support portion and a second end coupled with the intermediate restraint member.

39. The child carrier of claim 37, wherein the intermediate restraint member is padded.

40. The child carrier of claim 32, further comprising a crotch support portion, the crotch support portion intersecting the child back support portion, substantially surrounding the crotch support strap, and ending at a location near the upper end of the crotch support strap.

41. The child carrier of claim 32, wherein the one or more strap members are comprised of:

a left and a right generally vertically orientated strap the left and right generally vertically orientated straps each having a top end connected with one of the right and left child shoulder strap, and a bottom end; and a generally horizontally orientated strap, the generally horizontally orientated strap having attached therewith both generally vertically orientated straps and the crotch support strap.

42. The child carrier of claim 41, wherein the length of the crotch support strap is adjustable.

43. The child carrier of claim 32, wherein the crotch support strap and the vertically orientated strap are not fixed to one of the crotch support portion and the child back support portion, whereby the interconnected loop is afforded a measure of free rotational movement.

44. A child carrier comprising:

a rigid framework, the rigid framework including a front portion and rear portion;

at least one shoulder strap connected with the front portion;

a child cockpit suspended between the front and rear portions, the child cockpit including a child restraint harness, the child restraint harness comprising a right and a left child shoulder strap, each having an upper and a lower end, a crotch support having a back end and an upper end, the upper end being operatively connected with the lower ends of the right and left shoulder strap and one or more strap members, the one or more strap members connected with the back end of the crotch support strap and the top end of each of the pair of child shoulder straps; and a waist belt assembly, the waist belt assembly including hip-load transfer members that rest against the user's hip when the child carrier is being worn.

45. The child carrier of claim 44, further comprising a rigid canopy, the rigid canopy comprising:

(i) at least one arcuate rigid columnar member having front and rear ends;

(ii) at least one second front connector coupled with the front end, the at least one second front connector being removably connectable with the at least one first front connector;

(iii) at least one second rear connector coupled with the rear end, the at least one second rear connector being removably connectable with the at least one first rear connector; and (iv) a hood coupled with the at least one arcuate rigid columnar member, the hood being suspended over a significant portion of the child cockpit.

46. The child carrier of claim 44, wherein the front portion comprises:

(i) two generally vertical front columnar members, the two front columnar members spaced from each other, each having a top end; and (ii) a rigid yoke, the rigid yoke connected with the two front columnar members substantially at the top end of each said front columnar member.

47. The child carrier of claim 44, wherein the waist belt assembly is adjustable.

48. The child carrier of claim 44, further comprising a waist belt assembly, the waist belt assembly including hip-load transfer members that rest against the user's hip when the child carrier is being worn.

49. A child carrier comprising:

a rigid framework, the rigid framework including a front portion and a rear portion, the front portion comprising two generally vertical front columnar members, the two front columnar members spaced from each other, each having a top end, and a rigid yoke, the rigid yoke connected with the two front columnar members substantially at the top end of each said front columnar member, the yoke having formed therein a first slot, the first slot having a width and height of sufficient dimensions so that at least four adult human fingers can be inserted therein;

a child cockpit suspended between the front and rear portions; and at least one shoulder strap connected with the front portion.

* * * * *